US010233605B2

(12) United States Patent
Cheung et al.

(10) Patent No.: US 10,233,605 B2
(45) **Date of Patent: *Mar. 19, 2019**

(54) OFFSHORE BIPOD

(71) Applicant: Keppel Offshore and Marine USA., INC.

(72) Inventors: Tak On Cheung, Sugar Land, TX (US); Peter Noble, Spring, TX (US)

(73) Assignee: KEPPEL OFFSHORE AND MARINE USA., INC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/146,492

(22) Filed: May 4, 2016

(65) Prior Publication Data

US 2016/0326706 A1 Nov. 10, 2016

Related U.S. Application Data

(60) Provisional application No. 62/156,709, filed on May 4, 2015.

(51) Int. Cl.
*E02B 17/00* (2006.01)
*E02B 17/02* (2006.01)

(52) U.S. Cl.
CPC ..... *E02B 17/0021* (2013.01); *E02B 17/02* (2013.01); *E02B 2017/0043* (2013.01); *E02B 2017/0069* (2013.01); *E02B 2017/0073* (2013.01)

(58) Field of Classification Search
CPC ..... E02B 17/00; E02B 17/025; E02B 17/027; E02B 17/0017; E02B 17/0021; E02B 17/02; E02B 17/028; E02B 2017/0039; E02B 2017/0043; E02B 2017/0056; E02B 2017/0069; E02B 2017/0073; E02B 2017/0095
USPC ..... 405/203, 204, 205, 207, 208, 217
See application file for complete search history.

(56) References Cited

U.S. PATENT DOCUMENTS 3,807,179 A * 4/1974 Stone ..... E02B 17/0021 114/40
4,077,225 A * 3/1978 Lichtenberger ..... E02B 17/0021 114/42
4,245,929 A * 1/1981 Pearce ..... E02B 17/0021 114/40
4,253,780 A * 3/1981 Lecomte ..... E02B 17/00 14/77.3
4,505,618 A * 3/1985 Yashima ..... B63B 1/107 405/195.1
4,784,526 A * 11/1988 Turner ..... E02B 17/0021 166/335
4,973,198 A * 11/1990 Cox ..... E02B 17/021 405/195.1

(Continued)

*Primary Examiner* — Benjamin F Fiorello
*Assistant Examiner* — Stacy N Lawson
(74) *Attorney, Agent, or Firm* — Duane Morris LLP

(57) ABSTRACT

A bipod for use in ice prone offshore environments comprising a deck connected across a pair of members, each member having a neck, and angled portion disposed at the sea surface, and a base secured to the seafloor. The base is secured using a gravity-based system or pilings. An interior zone is defined between the pair of members which is maintained largely free of ice and provides ready access to the sea surface for resupply or emergency egress.

19 Claims, 10 Drawing Sheets

(56) References Cited

U.S. PATENT DOCUMENTS

| | | | | |
|---|---|---|---|---|
| 8,821,071 | B2 | 9/2014 | Aurora et al. | |
| 2012/0128434 | A1* | 5/2012 | Shafer | E02B 17/0021 405/217 |
| 2014/0147214 | A1* | 5/2014 | Foo | E02B 17/0021 405/196 |
| 2014/0147215 | A1* | 5/2014 | Foo | E02B 17/08 405/196 |

* cited by examiner

OFFSHORE BIPOD

RELATED AND CO-PENDING APPLICATIONS

This application is a utility of and claims priority to co-pending provisional application entitled "Offshore Bipod" Ser. No. 62/156,709 filed on 4 May 2015 the entirety of which is incorporated herein by reference.

FIELD OF THE INVENTION

The present disclosure generally relates to an offshore platform. More specifically, the present disclosure relates to an offshore bipod platform configured for development of undersea hydrocarbon resources in regions where ice is a potential hazard to such development.

BACKGROUND

Significant efforts are underway to explore and develop hydrocarbon resources in extreme environments such as the Arctic Ocean. Resource development is hampered in arctic regions by numerous hazards including ice, which impedes transportation and requires structures suitable to withstand the tremendous pressures exerted by multi-year floes (sheets of floating ice). Multi-year ice is understood to be ice which has survived at least one summer melting period and is thus more compacted and harder than newer ice. Structures capable of surviving such extreme conditions are generally expensive and tend to hamper production of the resource. Specialized structures are therefore needed to improve the economic viability of offshore hydrocarbon recovery.

BRIEF DESCRIPTION OF THE DRAWINGS

The foregoing and other advantages of the present disclosure will become apparent upon reading the following detailed description and upon reference to the drawings.

Figure 1A:
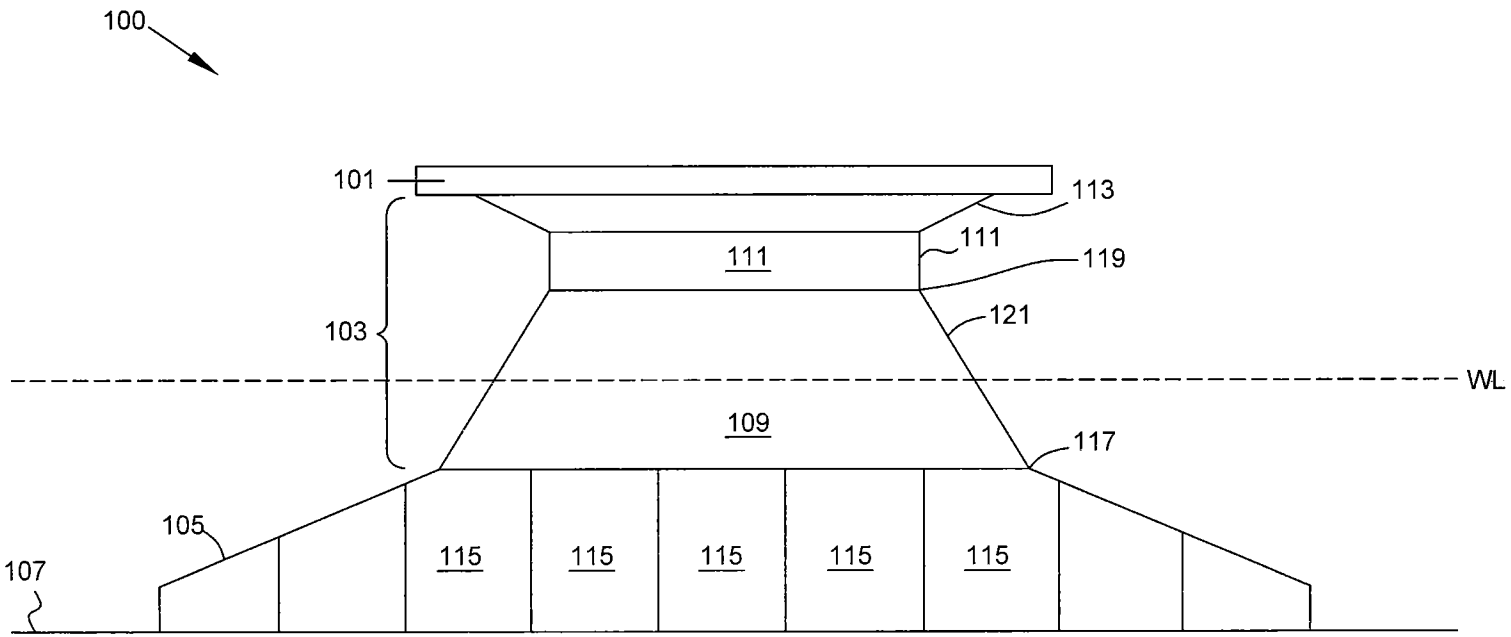
FIG. 1A is a side profile view of a gravity-based structure known in the art.

While the present disclosure is susceptible to various modifications and alternative forms, specific embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the disclosure as defined by the appended claims.

DETAILED DESCRIPTION

Existing solutions to the problem of multi-year floes include gravity-based structures (GBS) and piled structures. Both GBS and piled structures typically use a conical shape at the waterline to assist in withstanding the force exerted by ice and floes against the structure.

A GBS is a large compartmentalized structure, made typically of steel and/or concrete but which may also include composite, ceramic, or other appropriate materials, which is positioned over a development site and lowered to the seafloor by at least partially filling the compartments with metal pellets or similar heavy materials. The total weight of a GBS must be sufficient to resist the force of floes pushing against the structure. The seafloor beneath a GBS requires extensive preparation as soft or muddy materials must be removed and replaced with gravel to form a level surface onto which the GBS is lowered. Further, in water depths beyond 20 meters, a GBS must either be extended to a sufficient height or the seafloor must be built up to support the GBS, both of which are costly solutions. A GBS is thus unsuitable for smaller hydrocarbon fields in soft or muddy seafloors since seafloor preparation becomes prohibitively expensive. Further, a GBS is sufficiently expensive to manufacture, install, and maintain that these structures are generally only used for recovery of large, proven hydrocarbon reserves.

An exemplary GBS is illustrated as FIG. 1A and generally indicated with the numeral 100. A GBS 100 comprises a top deck 101, body 103, and base 105 which rests on seafloor 107. The waterline is indicated in FIG. 1A by a dashed line marked WL. Top deck 101 is cantilevered out beyond body 103. The body 103 typically comprises a first angled portion 109 which angles inwardly toward a neck portion 111. In some embodiments of a GBS 100, a further second angled portion 113 is positioned between neck portion 111 and top deck 101. Base 105 must rest on a level seafloor 107 and comprises a plurality of compartments 115 which may be filled with various heavy materials to ensure GBS 100 has sufficient weight to maintain its position on the seafloor 107 against the force of ice and floes.

The exterior of first angled portion 109 is a sloped, ice-engaging surface 121 which extends from shoulder 117 to neckline 119 and is designed to withstand the impact of floes which occur at the waterline WL. The shoulder 117 is below the waterline WL and the neckline 119 is above the waterline WL such that ice in the sea, particularly floating ice, engages the first angled portion 109 at the sloped, ice-engaging surface 121. The ice-engaging surface 121 extends around the periphery of the GBS 100 so that ice from any direction will come into contact with the first angled portion 109 at the ice-engaging surface 121. The slope of the ice-engaging surface 121 causes any sheet of ice to rise up the slope and bend to a point of breaking and is typically between 40 degrees and 60 degrees from the horizontal and more preferably about 55 degrees from the horizontal. Broken ice chunks, called rubble, will work their way around the first angled portion 109, driven by the sea current or wind. Above the neckline 119 is neck 111 that extends up to top deck 101, but preferably with an second angled portion 113 to turn back any ice that slides up the sloped, ice-engaging surface 121 to the full height of the neck 111. The full bending of ice that is engaged with the second angled portion 113 should break even the most robust masses of ice.

A piled structure includes a base having an arrangement for attaching to pilings which are driven into the seafloor. The seafloor pilings thus provide resistance to floe forces without the bulk and weight of a GBS. One example of this advantageous structure is the conical piled monopod described in U.S. Pat. No. 8,821,071.

Figure 1B:
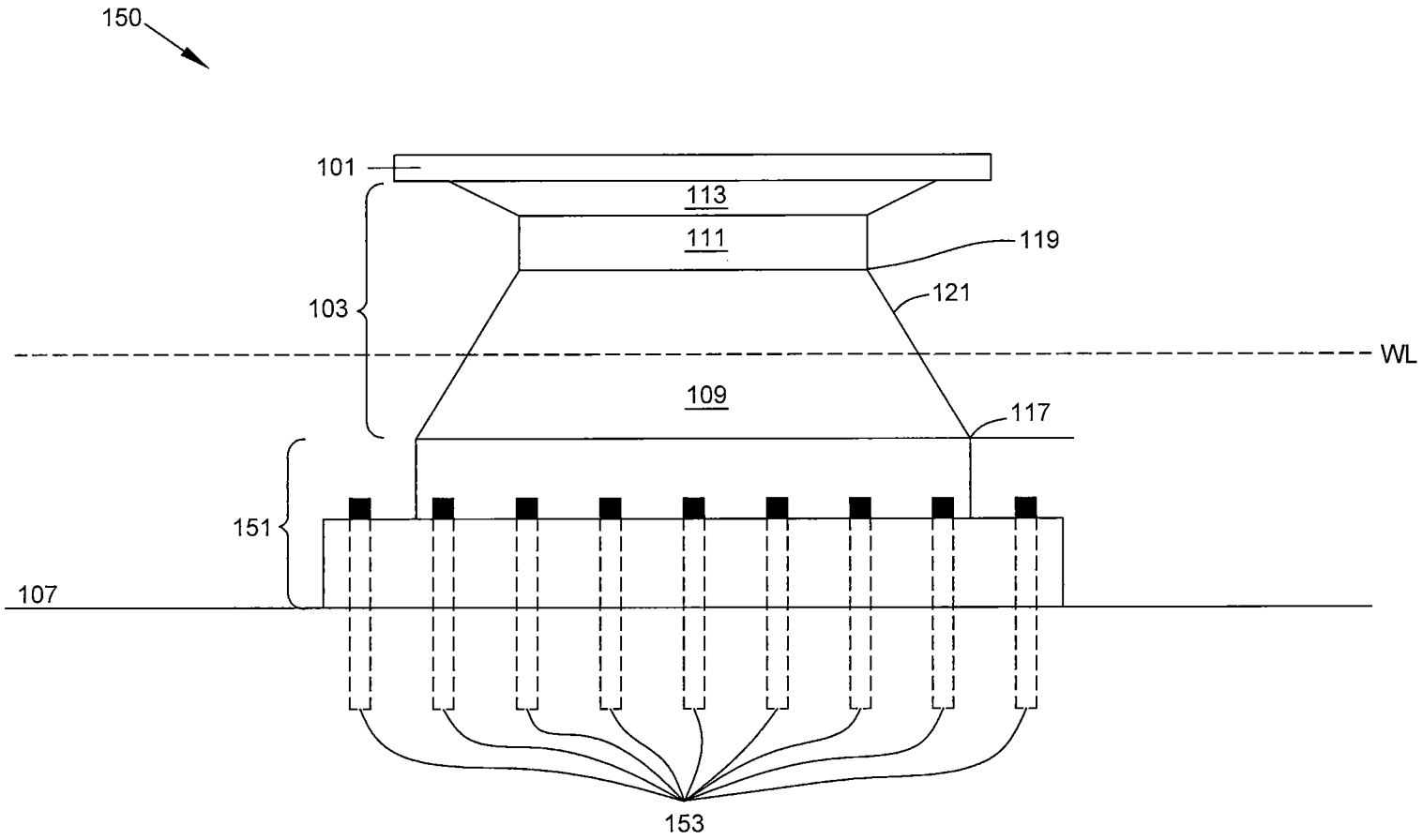
FIG. 1B is a side profile view of a piled structure known in the art.

An exemplary piled structure is illustrated in FIG. 1B and generally indicated with the numeral 150. A piled structure 150 comprises a top deck 101, body 103, and piled base 151. As with GBS 100, top deck 101 is cantilevered out past body 103, and body 103 comprises a first angled portion 109, neck portion 111, and may include a second angled portion 113. First angled portion 109 angles inwardly toward neck portion 111. The exterior of first angled portion 109 is a sloped, ice-engaging surface 121 which extends from shoulder 117 to neckline 119 and is designed to withstand the impact of floes which occur at the waterline WL.

Base 151 of piled structure 150 is configured to rest on the seafloor 107 and has the form of a flange with holes spaced around the perimeter adapted to accommodate pilings 153 which are driven into the seafloor 107. Thus pilings 153 provide the means for maintaining position of the piled structure 150 on the seafloor 107 against the force of ice and floes.

Although piled structures are an improvement over a GBS, both piled structures and a GBS still have several crucial limitations which may make them unsuitable for some applications in arctic conditions. For example, the conical shape of GBS and piled structures means that all hydrocarbon recovery must be carried out through the narrowest section of the structure, which also runs directly through the middle of any deck placed atop the structure. The conical shape also requires decking to be cantilevered away from the structure, which can add structural weaknesses and make access to the water surface difficult. The decking is difficult to install either at the manufacturing facility because of concerns for transporting the structure or on-site because of difficult working conditions and the need for stability during installation. Further, existing monopods are constrained in available deck space based on the width of their neck and base, resulting in some monopods being unsuitable for production of undersea hydrocarbons.

The present disclosure is directed to a bipod or split-cone structure which overcomes many of the deficiencies discussed above. In some embodiments a bipod for use in ice prone offshore environments comprises a first member and a second member disposed on a seafloor, each member comprising an angled portion, a neck, and a base, wherein each angled portion is a semi-conical semicylinder disposed at the waterline, and wherein the first and second members define an interior zone between them, and a deck connected across the neck of each of the first member and the second member. In some embodiments, the bipod is a gravity-based structure which is ballasted to the sea floor. In other embodiments, the bipod is a piled structure. The interior zone defined by first and second members is maintained substantially free of ice and provides ready access to the sea surface for resupply or emergency egress of bipod personnel.

Figure 2A:
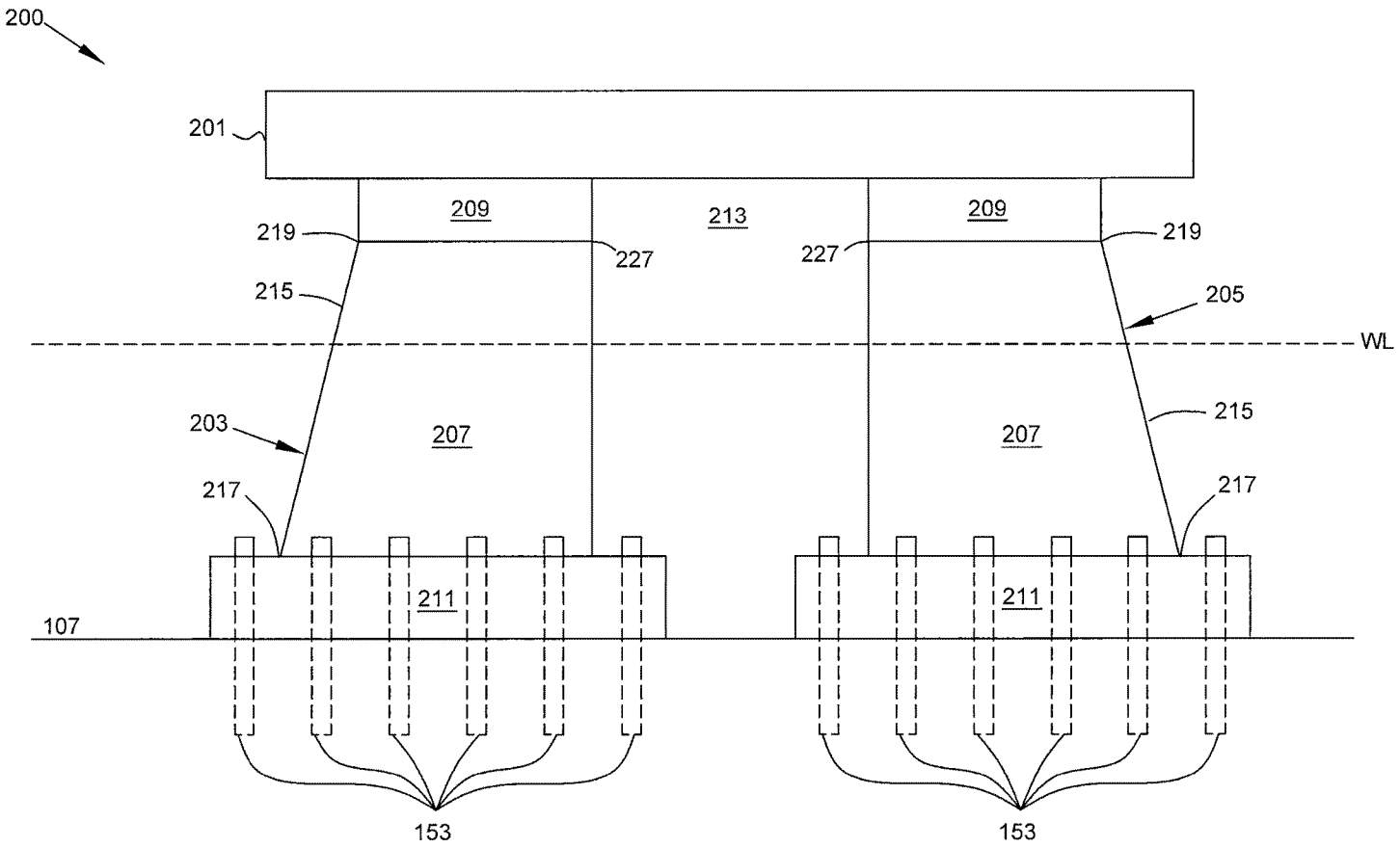
FIG. 2A is a side profile view of a piled bipod in accordance with some embodiments of the present disclosure.
Figure 2B:
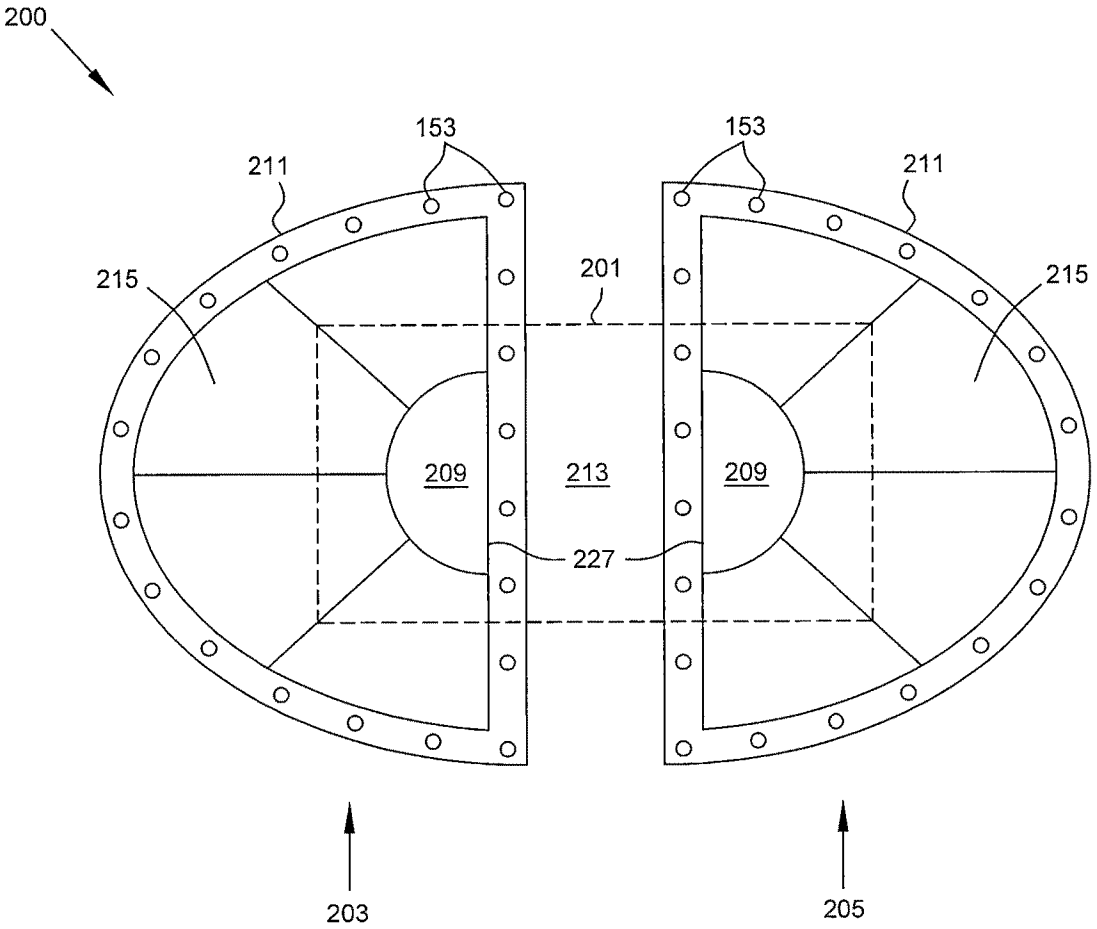
FIG. 2B is a plan view of a piled bipod in accordance with some embodiments of the present disclosure.
Figure 2C:
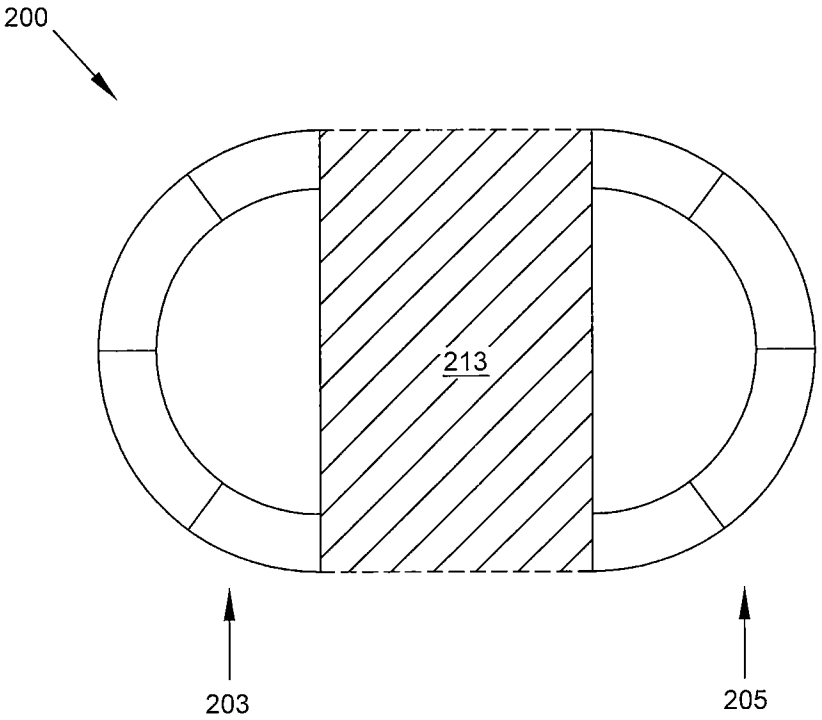
FIG. 2C is a plan view of a piled bipod above the waterline in accordance with some embodiments of the present disclosure.

In a first embodiment, illustrated in FIGS. 2A, 2B, and 2C, a piled bipod 200 is presented comprising deck 201 connected between first piled member 203 and second piled member 205. FIG. 2A is a side profile view of a piled bipod 200 in accordance with some embodiments of the present disclosure, while FIG. 2B is a plan view of piled bipod 200 and FIG. 2C is a plan view of piled bipod 200 above the waterline in accordance with some embodiments of the present disclosure.

With attention now to FIG. 2A, each of first piled member 203 and second piled member 205 comprise a neck 209, angled portion 207, and base 211. The exterior of angled portion 207 is a sloped, ice-engaging surface 215 which extends from shoulder 217 to neckline 219 and is designed to withstand the impact of floes which occur at the waterline WL. The shoulder 217 is below the waterline WL and the neckline 219 is above the waterline WL such that ice in the sea, particularly floating ice, engages the angled portion 207 at the sloped, ice-engaging surface 215. The ice-engaging surface 215 extends around the curved, external-facing periphery of the piled bipod 200, while the straight, internal-facing periphery comprises flat surface 227. The slope of the ice-engaging surface 215 causes any sheet of ice to rise up the slope and bend to a point of breaking and is typically between 40 degrees and 60 degrees from the horizontal and more preferably about 55 degrees from the horizontal. Broken ice chunks, called rubble, will work their way around the angled portion 205, driven by the sea current or wind. Above the neckline 219 is neck 209 that extends up to deck 201.

Base 211 comprises a flange having a plurality of holes to accommodate pilings 153 which are driven into the sea floor. While the piled bipod 200 rests on the seafloor 107, the weight of the piled bipod 200 is preferably carried by a plurality of pilings 153 that are driven deep into the seafloor 107 and then attached to the piled bipod 200. It is typical to drive the pilings 153 between about 35 and about 75 meters into the seabed to permanently fix the piled bipod 200 in its offshore location. The pilings 153 are typically strong, hollow tubes or pipe-like structures that act like long nails and provide a structurally efficient arrangement for a permanent platform for offshore hydrocarbon drilling and production operations. The pilings 153 have a relatively large diameter of between 1 and 3 meters with a wall thickness of about 2 to 10 cm. During installation of piled bipod 200, extensive preparation of the seafloor 107 is generally unnecessary since the weight of the piled bipod 200 is supported by the pilings 153. It is generally optional to provide granular material for leveling the installation site or to excavate muddy areas. Once the pilings 153 are driven into the seafloor 107 and firmly attached to the base 211, the pilings 153 provide resistance to: (a) forces that cause structures to slide along the seafloor, (b) forces that cause structures to overturn such as forces acting several meters above the base of a structure; and (c) forces that cause vertical movement both upwardly and downwardly. The resistance to both upward and downward motion or movement is important in resisting toppling forces that may be imposed by ice. The pilings 153 at the front side of the piled bipod 200 resist lifting forces that ice may impose on the upstream side to resist toppling over while the pilings 153 at the far side or back side or downstream side of the piled bipod 200 resist downward motion that would allow the back side to roll deeper into the seafloor 107. Using such long pilings provides a structurally efficient base for year around operations in an ice prone offshore ice environment that must resist ice loads that can be quite substantial. The pilings act like nails that hold the platform in place and are structurally more efficient than in the case of a GBS where resistance to overturning is provided only by the size and weight of the structure.

FIG. 2B provides a plan view of piled bipod 200 and illustrates the arrangement of pilings 153 around the base 211 of each of first piled member 203 and second piled member 205. Deck 201 is mounted above the neck 209 of each of first piled member 203 and second piled member 205.

As illustrated in FIGS. 2B and 2C, an interior zone 213 is defined as the area between first piled member 203 and second piled member 205 as seen above the waterline. This interior zone 213 is advantageously maintained free of ice and provides space for resupply and emergency egress.

In some embodiments, the ratio of the width of base 211 to the width of neck 209 is between 1.9 and 2.1 to 1. In other embodiments, the ratio of the width of base 211 to the width of neck 209 is between 2 and 3 to 1. In still further embodiments, the ratio of the width of base 211 to the width of neck 209 is between 1.5 and 2 to 1.

In some embodiments, the ratio of the width of angled portion 207 at shoulder 217 to the width of angled portion 207 at neckline 219 is between 1.9 and 2.1 to 1. In other embodiments, the ratio of the width of angled portion 207 at shoulder 217 to the width of angled portion 207 at neckline 219 is between 2 and 3 to 1. In still further embodiments, the ratio of the width of angled portion 207 at shoulder 217 to the width of angled portion 207 at neckline 219 is between 1.5 and 2 to 1.

Figure 3:
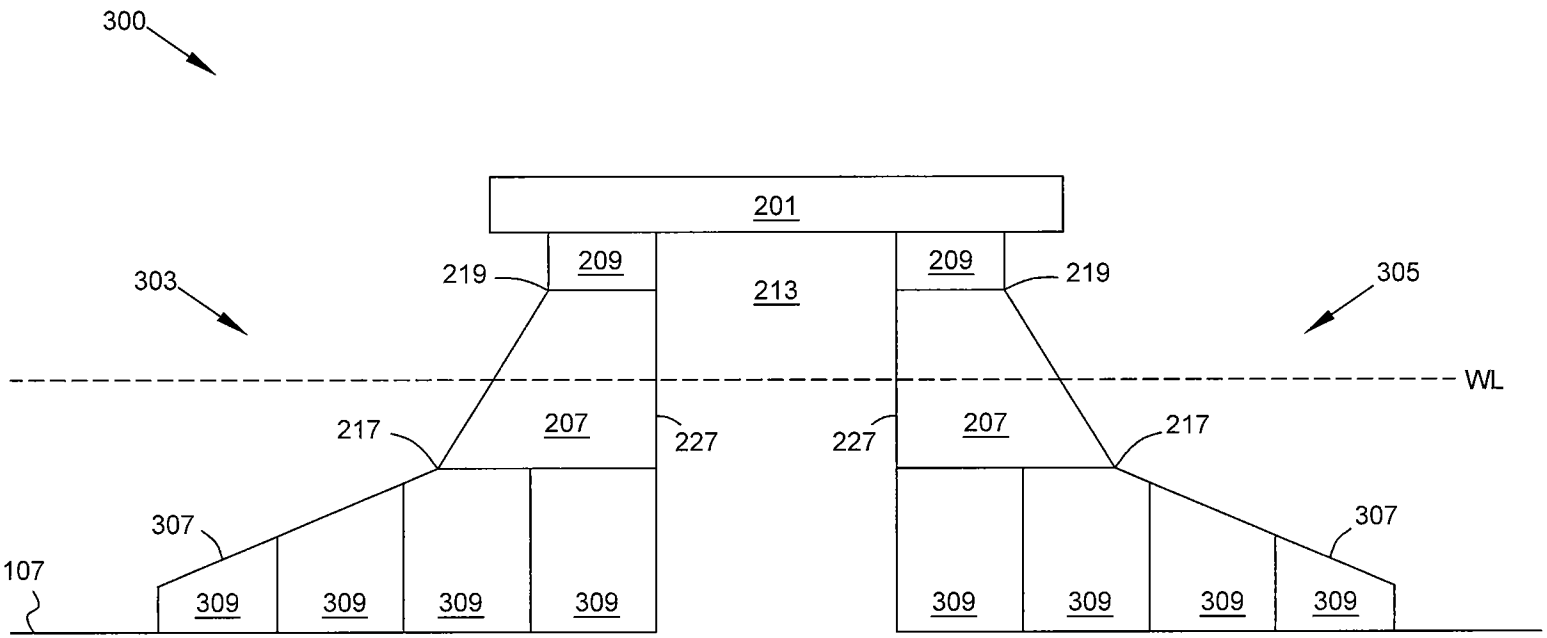
FIG. 3 is a side profile view of a gravity-based bipod in accordance with some embodiments of the present disclosure.

In another embodiment, illustrated in FIG. 3, a gravity-based bipod 300 is presented. FIG. 3 is a side profile view of a gravity-based bipod 300 in accordance with some embodiments of the present disclosure. Like objects are provided with like numerals to identify similarities in structure between the piled bipod 200 presented in FIGS. 2A, 2B, and 2C and the gravity-based bipod 300 presented in FIG. 3.

Gravity-based bipod 300 comprises deck 201 connected across a first member 303 and second member 305, each of which comprises a neck 209, angled portion 207, and base 307. The base 307 comprises a plurality of compartments 309 for ballasting; these compartments 309 are filled with heavy materials to provide sufficient weight to maintain the gravity-based bipod 300 in position.

Whether gravity-based or piled, the bipods presented herein provide numerous advantages over traditional monopod structures. First, the disclosed bipods allow for a significant time savings during installation at an offshore site. In arctic regions with limited warm months in which to conduct an installation, any time savings during the installation process is a major advantage. Here, the bipod provides a time savings because a jack-up can be used to pre-drill production wells after the first member is installed but before a second member or deck are installed.

Figure 4B:
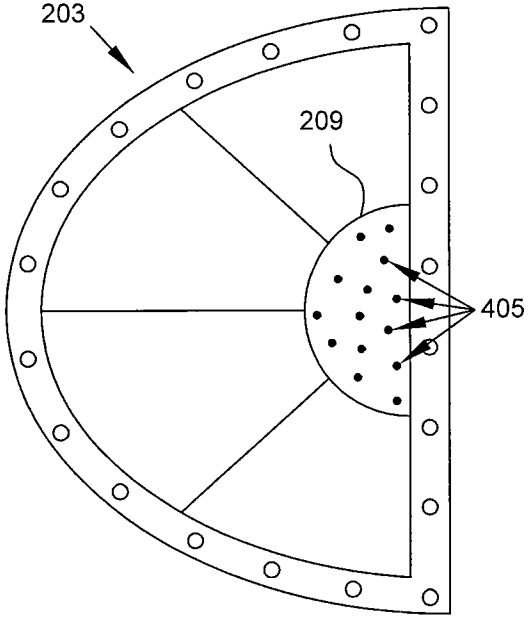
FIG. 4B is a plan view of a piled bipod with pre-drilled production wells in accordance with some embodiments of the present disclosure.
Figure 4A:
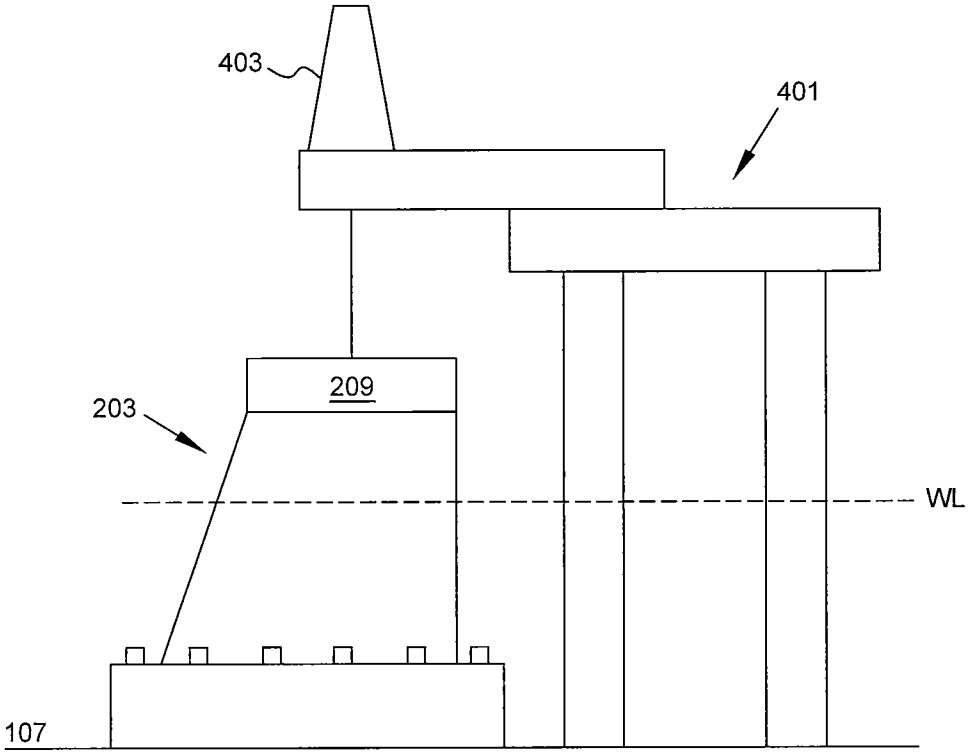
FIG. 4A is a side profile view of a piled bipod with alongside jack-up in accordance with some embodiments of the present disclosure.

FIGS. 4A and 4B provide a side profile and plan view, respectively, of an installed first member 203 and alongside jack-up 401 for pre-drilling a plurality of production wells 405. In some embodiments, jack-up 401 is a Keppel Arctic Jack-Up. The jack-up 401 is positioned such that a drilling rig 403 is disposed above neck 209, through which drilling rig 403 has access to the seafloor 107. Drilling rig 403 is thus able to drill the plurality of production wells 405 which will later be connected through the deck to begin production of undersea hydrocarbon resources. After the pre-drilling of at least one production well 405, a second member (not pictured in FIG. 4A or 4B) is installed and a deck is connected across first member 203 and second member to complete the offshore piled bipod. Although the bipod illustrated in FIGS. 4A and 4B is a piled bipod, one of skill in the art would appreciate that this advantage is similarly applied to a gravity-based bipod structure.

Figure 5:
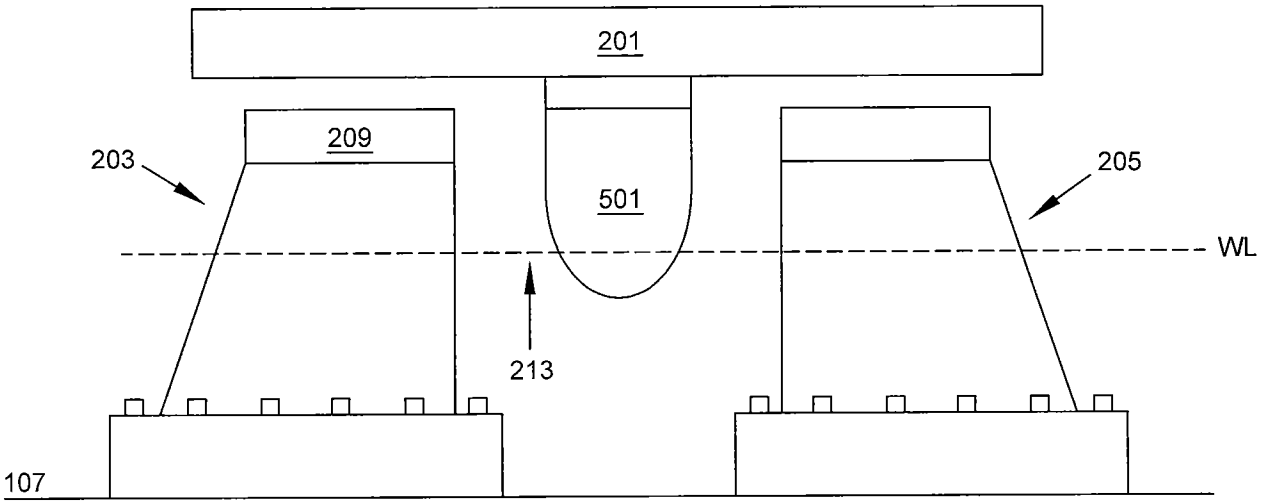
FIG. 5 is a side profile view of a float-over deck installation on a piled bipod in accordance with some embodiments of the present disclosure.

Additionally, as illustrated in FIG. 5, construction can be further expedited using a float-over method for installation of the deck 201 above first member 203 and second member 205. After first member 203 and second member 205 are secured to the seafloor 107, a barge 501, ship, or similar vessel enters the interior zone 213 conveying deck 201. The deck 201 can then be properly positioned and secured to first member 203 and second member 205. This method achieves a considerable time savings as the pre-constructed deck is affixed to first member 203 and second member 205 without the need for additional construction. Although the bipod illustrated in FIGS. 4A and 4B is a piled bipod, one of skill in the art would appreciate that this advantage is similarly applied to a gravity-based bipod structure.

Figure 6:
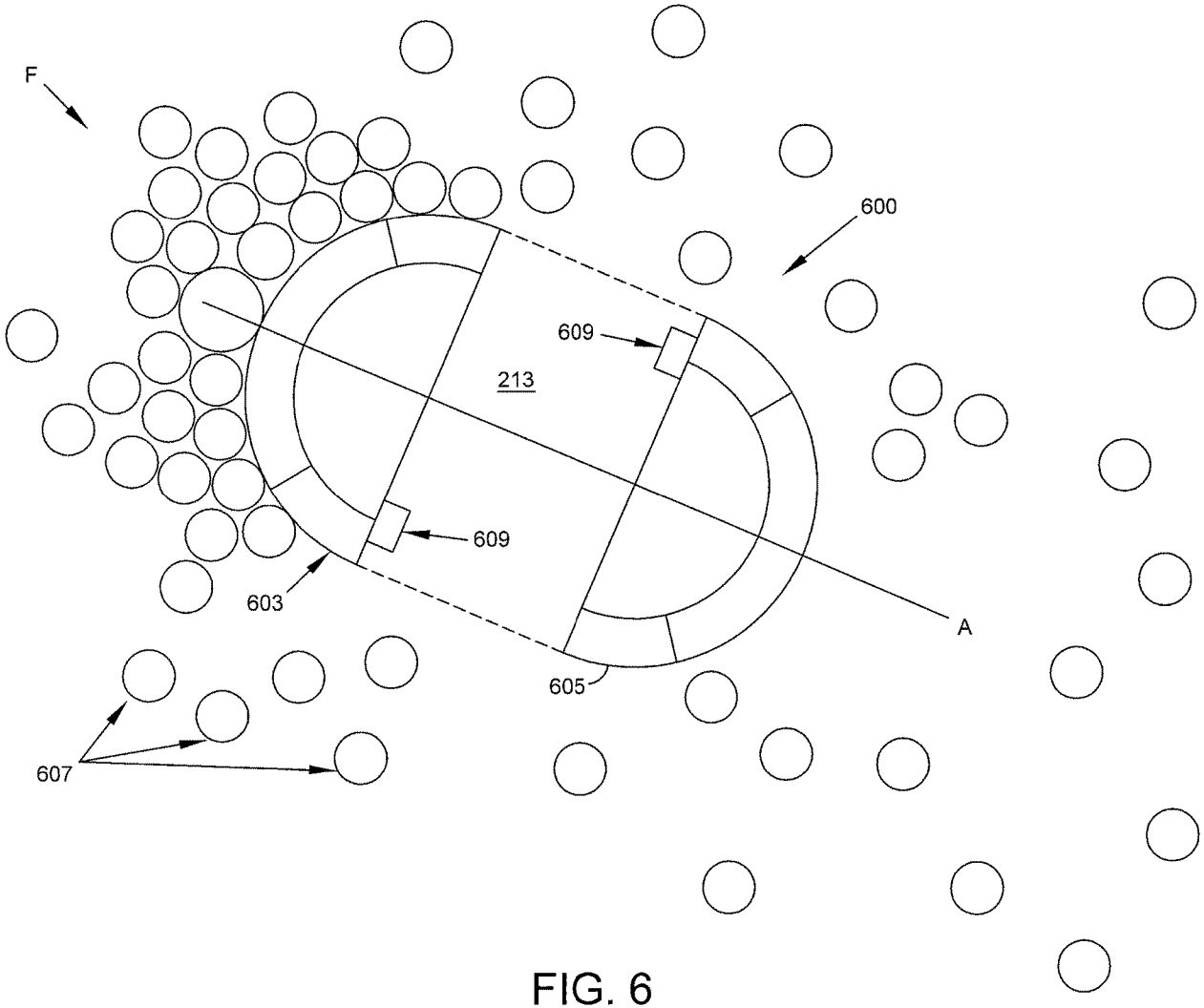
FIG. 6 is a plan view of a bipod operating in an ice field in accordance with some embodiments of the present disclosure.

In some embodiments, the presented bipods are advantageously positioned to maintain interior zone 213 substantially free of ice buildup. As illustrated in FIG. 6, a bipod 600 is positioned along an axis A which is parallel to the predominate sea surface currents or floe movement, indicated by arrow F. Ice pieces 607 build up against the upstream member 603 and, as discussed above and described with reference to FIGS. 2A, 2B, 2C, and 3, engages the angled portion of upstream member 603 at a sloped, ice-engaging surface. The slope of the ice-engaging surface causes any sheet of ice to rise up the slope and bend to a point of breaking. Broken ice chunks work their way around the upstream member 603, driven by the sea current or wind. In this manner, interior zone 213, which is downstream of the upstream member 603, can be kept substantially clear of ice or, in more extreme conditions, at least substantially clear of solid ice. This is advantageous as it provides access to the water surface for resupply or emergency egress. Additional areas downstream of the downstream member 605 may also be substantially free of ice. Operators of the bipod 600 may also use ice management vessels to maintain interior zone 213 substantially clear of ice or, in more extreme conditions, at least substantially clear of solid ice.

In yet further embodiments, bipod 600 includes mechanical devices 609 which assist in maintaining the interior zone 213 substantially free of ice build-up. In some embodiments, mechanical devices 609 are thrusters, propellers, or undersea fans affixed to one or more of upstream member 603 and downstream member 605. In some embodiments, mechanical devices 609 are positioned at or just below the sea surface, or just below the ice level. Mechanical devices 609 can be energized to provide thrusting power against encroaching ice or to clear interior zone 213 of ice. Mechanical devices 609 are configured to be operated remotely (e.g. by personnel on the deck of bipod 600 or even by personnel in remote locations), thus allowing for remote ice management of the interior zone 213.

The presented bipods further allow for advantages in manufacture, transport, and installation. Use of a bipod, rather than monopod, structure generally means that each member of the bipod will be smaller and lighter than the single member of a monopod. Thus, bipod members may be manufactured in smaller drydock or construction facilities, and transported more readily to installation sites offshore. Whereas some large monopods require specialized construction facilities, bipod members can be constructed in a wider range of facilities; for example, some large monopods require special dry docking facilities which bipod members would not. Once on site, bipod members have a smaller footprint than monopods and thus require less seafloor preparation, allowing for faster installation times. The overall result of a smaller, lighter, and more quickly installed offshore platform is generally one that is also less expensive than prior art gravity-based or piled monopods.

Finally, the presented bipods present advantages in the arrangement of the deck. As discussed above, monopods typically offer limited access to the seafloor through the narrow neck region (e.g. neck 111 of FIG. 1A). This limited access runs through the center of top deck 101, requiring all production and production support equipment to be clustered in the center of top deck 101 while additional structures such as personnel support spaces are along the periphery of top deck 101. In contrast, in a bipod presented above, production equipment is generally limited to opposing ends of the deck, allowing a safer layout with personnel support spaces clustered central to the platform and will easy access to interior zone 213 for resupply and emergency egress.

It may be emphasized that the above-described embodiments, particularly any "preferred" embodiments, are merely possible examples of implementations, merely set forth for a clear understanding of the principles of the disclosure. Many variations and modifications may be made to the above-described embodiments of the disclosure without departing substantially from the spirit and principles of the disclosure. All such modifications and variations are intended to be included herein within the scope of this application.

Figure 7:
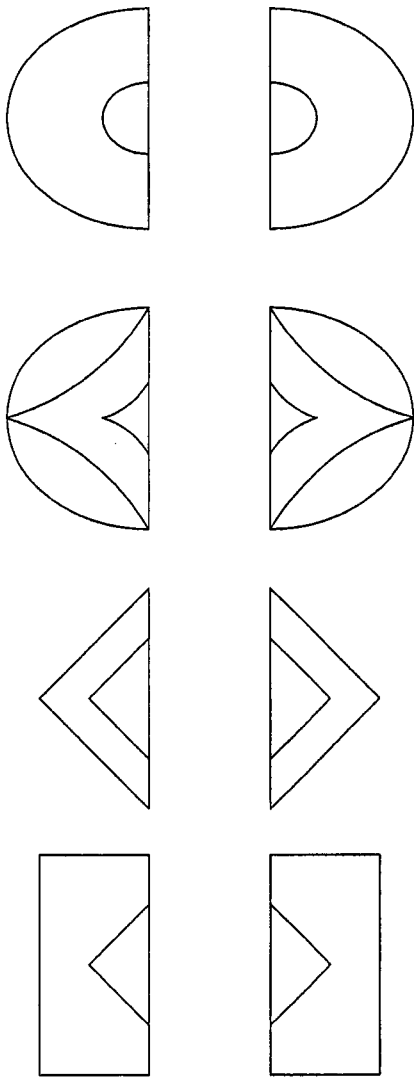
FIG. 7 is a plan view of alternative shapes for use with a bipod in accordance with some embodiments of the present disclosure.

While the embodiments described herein are semicircular, split ellipses, hyperbolas, parabolas, as well as wedges are equally envisioned depending on the degree of variability with respect to the direction of movement of the floes, and other design considerations. Other examples are provided in FIG. 7.

While this specification contains many specifics, these should not be construed as limitations on the scope of any disclosures, but rather as descriptions of features that may be specific to particular embodiment. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments.

What is claimed is:

1. A bipod for use in ice prone offshore environments, comprising:

a first member and a second member disposed on a seafloor, each member comprising an angled portion, a neck, and a base, wherein each angled portion is disposed at the waterline, each base below the waterline, and each neck above the waterline and wherein each base is half conical in shape; wherein each angled portion comprises a first side and a second side, the first side of the first member facing the first side of the second member, the second side of the first member and the second side of the second member disposed opposite the respective first sides; the first side of the first member and the first side of the second member being parallel to one another and normal to the seafloor, wherein the second side of the first member and the second side of the second member are half conical in shape;

wherein each base has a cross-sectional area taken along a horizontal plane that is greater than a cross-sectional area taken along a horizontal plane of the respective neck and wherein the first and second members are separated by an interior zone between them; and a deck connected across the necks of each of the first member and the second member.

2. The bipod of claim 1 wherein each base comprises a plurality of compartments for filling with ballast for securing each base to the seafloor.

3. The bipod of claim 1 wherein each base comprises a flange with a plurality of holes, each hole adapted to accommodate a piling driven into the seafloor in order to secure each base to the seafloor.

4. The bipod of claim 3 wherein each base has a width twice as large as a width of the respective neck.

5. The bipod of claim 3 further comprising at least one mechanical device connected to one of the first member and the second member, the mechanical device disposed in the interior zone and adapted to clear ice from the interior zone.

6. The bipod of claim 3 wherein the width of each angled portion where the respective angled portion meets the respective neck is one half the width of the respective angled portion where it meets the respective base.

7. The bipod of claim 1, wherein the interior zone is defined by a flat side of the first member and an opposing flat side of the second member.

8. The bipod of claim 7, wherein the interior zone is configured to extend below the waterline.

9. The bipod of claim 1, wherein the interior zone is upwardly bounded by the deck.

10. A method of positioning a bipod in an ice prone offshore environment, wherein the bipod consists of a first leg and a second leg disposed on a seafloor, each leg having an angled portion, a neck, and a base, wherein each angled portion is disposed at the waterline and has a semi-conical shape, and wherein the first and second legs define an interior zone between them; and a deck connected across the neck of each of the first leg and the second leg, the method comprising:

determining the prevailing direction of ice floes in the offshore environment; and aligning the first and second legs such that a line from the first leg to the second leg is parallel to the prevailing direction.

11. The method of claim 10, further comprising affixing the base of the first and second legs to the sea floor.

12. The method of claim 11, wherein the step of affixing the base further comprises driving pilings into the sea floor.

13. The method of claim 11, wherein the step of affixing the base further comprises filling the base with ballast.

14. The method of claim 10, further comprising clearing the interior zone of ice.

15. A method of building a bipod in an ice prone offshore environment, wherein the bipod consists of a first member and a second member disposed on a seafloor, each member having an angled portion, a neck, and a base, wherein each angled portion is disposed at the waterline and has a semi-conical shape, and wherein the first and second members define an interior zone between them; and a deck connected across the neck of each of the first member and the second member, the method comprising:

positioning the first member on the seafloor in the offshore environment;

positioning a jack up structure with a drilling rig proximate to the first member;

pre drilling a plurality of production wells with the drilling rig;

positioning the second member on the seafloor relative to the first member, subsequent to the step of pre drilling;

positioning the deck between the first and second member; and connecting the plurality of production wells to the deck.

16. The method of claim 15, further comprising the step of affixing the first member to the sea floor.

17. The method of claim 16, further comprising the step of affixing the second member to the sea floor subsequent affixing the first member to the sea floor.

18. The method of claim 16, wherein the steps of positioning the first member and the second member on the seafloor comprise floating the respective first and second member into position and submerging the base of the respective first member and the base of the respective second member.

19. A bipod for use in ice prone offshore environments, consisting of:

a first leg disposed on the seafloor:

the first leg having a first mid section, a first neck section and a first base section, wherein the first mid section is disposed at the waterline, the first base section below the waterline, and the first neck section above the waterline; wherein cross sections of each of the first mid section and the first base section have a perimeter including a first straight section connecting respective ends of a curved section, the curved section being symmetric about a line perpendicular to the straight section; the first leg being tapered from the first base section to the first neck section;

a second leg disposed on the seafloor:

the second leg having a second mid section, a second neck section and a second base section, wherein the second mid section is disposed at the waterline, the second base section below the waterline, and the second neck section above the waterline; wherein cross sections of each of the second mid section and the second base section have a perimeter including a second straight section connecting respective ends of a curved section, the curved section being symmetric about a line perpendicular to the second straight section; the second leg being tapered from the second base section to the second neck section;

wherein the curved sections of the first leg and the curved sections of the second leg are oriented away from one another and the straight sections of the first leg and the straight sections of the second leg define opposing faces of the first and second legs;

an interior channel defined between the opposing faces of the first and second legs; and, a deck connected across from the first neck section of the first leg to the second neck section of the second leg, the deck defining a top of the interior channel, wherein the bipod is oriented such that the interior channel is perpendicular to a prevailing direction of ice floes in the ice prone offshore environment.

* * * * *